US006960747B2

(12) United States Patent
Risman

(10) Patent No.: US 6,960,747 B2
(45) Date of Patent: Nov. 1, 2005

(54) MICROWAVE APPLICATOR SYSTEM

(75) Inventor: Per Olov G. Risman, Harryda (SE)

(73) Assignee: Personal Chemistry I Uppsala AB, Uppsala (SE)

( * ) Notice: Subject to any disclaimer, the term of this patent is extended or adjusted under 35 U.S.C. 154(b) by 200 days.

(21) Appl. No.: 10/289,400

(22) Filed: Nov. 7, 2002

(65) Prior Publication Data

US 2003/0102306 A1 Jun. 5, 2003

Related U.S. Application Data

(60) Provisional application No. 60/332,329, filed on Nov. 9, 2001.

(51) Int. Cl.[7] ..... H05B 6/70

(52) U.S. Cl. ..... 219/690; 219/693; 219/295; 219/701; 219/750; 219/694; 219/697; 219/76; 333/225; 333/228; 333/230; 333/231; 333/232

(58) Field of Search ..... 219/690, 693–697, 219/701, 746, 750–752, 762; 333/225–228, 230–233

(56) References Cited

U.S. PATENT DOCUMENTS 3,810,248 A * 5/1974 Risman et al. ..... 219/746
5,756,975 A * 5/1998 Harris et al. ..... 219/696

* cited by examiner

*Primary Examiner*—Shawntina Fuqua
(74) *Attorney, Agent, or Firm*—Harness, Dickey & Pierce, P.L.C.

(57) ABSTRACT

A microwave applicator for heating loads being a waveguide transition between the rectangular $TE_{10}$ and $TE_{20}$ modes comprising a $TE_{10}$ mode section and a $TE_{20}$ mode section. The location of the load being inside said $TE_{20}$ mode section and with its major axis perpendicularly to the major propagation direction of the $TE_{20}$ mode, close to a shorting wall of said $TE_{20}$ mode section and also close to the centreline of said propagation direction.

26 Claims, 3 Drawing Sheets

MICROWAVE APPLICATOR SYSTEM

This application claims benefit of Ser. No. 60/332,329 filed on Apr. 9, 2001

BACKGROUND OF THE INVENTION

The present invention relates to a microwave applicator, to a system of microwave applicators and also to a method of using the applicator and the system in accordance with the preambles of the independent claims.

Furthermore, the field of microwave applicators to which to present invention belongs include those types having a load continuously transiting the heating chamber or chambers of the system. The present invention is an improvement of heating systems consisting of mainly multiple single mode applicator assemblies in which the load to be heated has a constant cross section.

DESCRIPTION OF THE PRIOR ART

Many different kinds of microwave systems for loads fulfilling the above characteristics exist. The simplest such applicator is a large multimode cavity, which may have holes in its walls (then preferably with attached metal tubes confining the microwaves to the cavity). For very small loads, the short circular single mode $TM_{010}$ cavity is well known, but has the drawback that it can only take loads up to about 10 mm in diameter under favourable conditions, at the common microwave frequency of 2450 MHz. Better efficiency may be obtained with a longer circular $TM_{01p}$ applicator.

Only single mode systems are of concern in this context, so the question is what significant other modes than the simplest TM mode ($TM_{01}$) may be useful and known. It is then of interest which mode types are created inside a load which can for this purpose be of a circular cross section.

Using the load axis as reference, there are then transverse electric (TE) and transverse magnetic (TM) modes. Any TE modes used for the excitation of the load field have inherently a high impedance, and the typical loads of primary concern herein have a rather high permittivity, mainly between 10 and 70, and will therefore have a low impedance. Furthermore, the lossiness of dielectric loads is by an equivalent electrical conductivity, but since TE modes lack an axial electric field component there is neither any efficient coupling for small loads nor any possibility to avoid a minimum axial length of the applicator of about half a free space wavelength. TE modes are thus inferior to TM for the purpose here: namely allowing variations of the load permittivity, and using an axially short applicator, while maintaining high microwave efficiency.

The lowest order TM mode in the load is of the $TM_0$ type. This has a rotationally symmetric field and provides maximum heating at the load axis. The most advanced version is described in the patent DE-2345706, where the load diameter is chosen so large that the heating intensity at the load periphery is very low; the applicator is then of the $TM_{02}$ type. A drawback with that system is that the bound wave propagating at and in the dielectric rod-shaped load is that a very large fraction of its field energy resides inside the rod. This results in difficulties to confine the heating to only the load part inside the applicator, which in turn makes it necessary to allow axial zones outside the applicator with a length comparable to about twice the penetration depth, for residual heating and leakage protection. Good external choking by wavetraps just outside the applicator is not possible due to the substantial field confinement inside the rod-shaped load. This is disadvantageous particularly when one or several axially short applicators are used in order to achieve a high power in density in the load. Another drawback is the need for such large applicator diameter that excitation of the disturbing $TM_1$ mode is difficult to avoid.

The next higher order TM mode in the load is of the $TM_1$ type. The heating pattern in the cross section of a reasonably circular load has then two diametrically located maxima, with a diametrical zone of zero heating at ±90°. A microwave heating applicator with this mode is described in for example the patent U.S. Pat. No. 5,834,744. The applicator disclosed in that patent is excited by two diametrical slots fed by a common waveguide arranged in such a way that the $TM_0$ modes are suppressed. In order for this particular feed system to work, the applicator is circular or polygonal, with the load located at the central axis, and the applicator mode is characterised by being of the $TM_{120}$ type. Additionally, the applicator design is dedicated for functioning with a longest possible axial length of the load of the order of one free space wavelength.

A waveguide mode transducer from rectangular $TE_{10}$ to $TE_{20}$ is described in for example the patent GB-1364734. The transducer system is used to heat a wide and flat load moving past the end of the $TE_{20}$ waveguide. For that reason, stubs are placed in the waveguide to create mode impurities which would result in a heating pattern caused by a combination of that by the $TE_{10}$ and $TE_{20}$ modes, in an added external cavity with at least two such applicators and equipped with load rotation means.

One drawback with this known device is that the load needs to be wide and flat which limits the possibilities to heat larger volumes and also limits the possibility to control e.g. the heating rate.

The objects of the present invention are to achieve an applicator and a system of applicators that enable heating of load having a large cross section, that make it possible to more accurately control e.g. the heating rate and that better confine the heating in the load.

SUMMARY OF THE INVENTION

The above-mentioned objects are achieved by an applicator, a system and also by a method according to the independent claims.

Preferred embodiments are set forth in the dependent claims.

The system of microwave applicators according to the present invention consists mainly of multiple air-filled single mode applicators in which the load to be heated has a constant cross section.

A characteristic feature of the present invention is that the $TM_1$ type field in the load is created by using an applicator in which the basic second order electrical mode, in the terminology of the theory for multipole fields, is created. This is characterised by two maxima of the electrical field at opposite sides of the axis of the load; in its pure form this occurs in a closed circular $TE_{110}$ or $TE_{120}$ cavity. The simplest rectangular waveguide or resonator in which this electric mode exists carries the $TE_{20}$ mode.

The microwave applicator is for applying microwave power to a load that preferably has a constant cross section. The applicator is a mode transducer from rectangular $TE_{10}$ at the generator end to $TE_{20}$ at the application end and the load is located approximately centred and near a shorting wall of the latter section. In a system using at least two applicators the mutually 90° displaced applicators in multiapplicator stacked assemblies have two additional functions: to confine the heating to take place mainly inside each applicator by choking action, and to act as a filter which reduces the crosstalk between adjacent applicators. The field in the load is of the cylindrical $TM_1$ type and the pattern is improved by adding for example tuning rods between the opposite waveguide walls near the load.

In cases where a high power density in the load is desired, the height of the applicator is made low; if this height is less than a half free space wavelength there can then be no mode with higher middle index than 0, i.e. the applicator fields are in principle the same at all levels. By then using a $TE_{10}$ waveguide feed the advantages addressed in the present application is utilised, such as stacking several applicators with a common load axis and then displacing adjacent applicators by 90°, so that not only an improved overall heating pattern in a flowing load is obtained, but also a choking action between adjacent applicators so that the microwave propagation between them through the load is strongly reduced.

The present invention is not limited to using a $TE_{10}$ waveguide with approximately half the width of the $TE_{20}$ part of the applicator, as shown in FIG. 1—but also a generalised feed where a portion includes a dielectric-filled waveguide carrying an equivalent mode to the rectangular $TE_{10}$, which is also equivalent to the circular $TE_{11}$ mode.

The invention also includes applicators with larger heights, up to more than a full free space wavelength. The uses of such applicators are typically not for continuously flowing loads but instead for stationary liquid loads in a round cylindrical microwave transparent container. Such loads may be stirred by additional mechanical means such as a rotating beating device or a magnetic stirring system utilising small, magnetised bodies in the liquid. The uneven heating pattern with two maxima in the circular cross section is then overcome. In order for the axial evenness of the heating pattern to be maintained, also under conditions where the filling height and dielectric properties of the liquid vary, additional means are introduced according to the present invention.

DETAILED DESCRIPTION OF THE INVENTION

The desired excitation type is the circular $TM_1$ field in a load, which is considered to have a small diameter for the purpose of this reasoning. In a circularly cylindrical cavity with a centred axial load and where the feed is ignored for the moment, the mode is then $TM_{110}$. The simplest rectangular mode type in an empty waveguide that can excite the same load field type is the $TE_{20}$ waveguide mode. The field along the centreline of propagation is then only magnetic, in the direction of propagation along the waveguide.

Even if, in principle, waveguides and cavities of any shape allowing the load to be excited by this field type are within the scope if the invention, certain excitation methods and means as well as constraints in mechanical design result in practical limitations. Hence, the applicators according to the invention have single feeds at the periphery of the waveguide-like structure, which has zero index in the axial (height) direction of the load. The simplest such structure is thus a rectangular $TE_{201}$ cavity, but the feedings according to the invention and the fact that there is a net power propagation from the feeding towards the load will result in the last index being somewhat undefined, and in any case this distance to be more than half a guide wavelength in that direction.

Hence, a first example of the simplest applicator cross section perpendicular to the load axis is a rectangular box supporting a field which can best be described as rectangular $TE_{202}$. For improving the mode purity, and compensating against the field modifications caused by the feed, a part of the rectangular shaped applicator wall opposing and across from the feeding has a triangular cut. This is schematically illustrated in FIG. 1.

Figure 1:
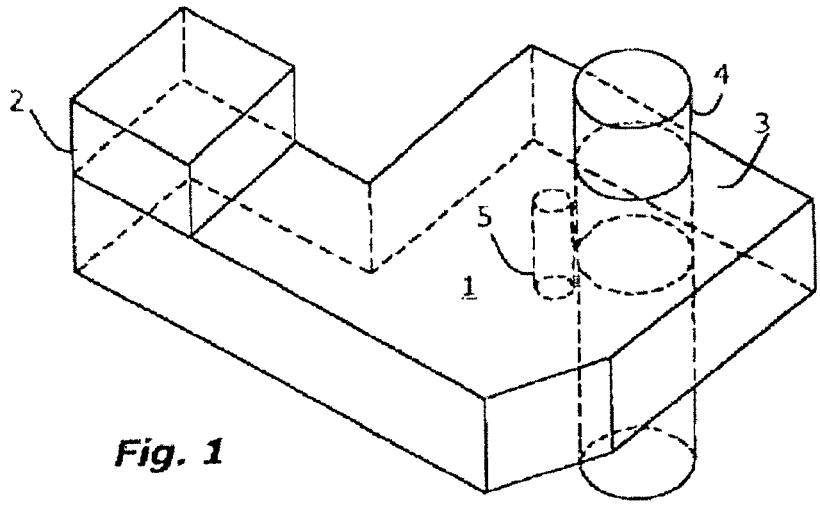
FIG. 1 shows, in perspective, an applicator according to the invention, with a rod-shaped load extending through it.

Referring now to the figures, and most particularly to FIG. 1, the first embodiment of the present invention relates to a rectangular $TE_{10}/TE_{20}$ mode applicator (or transducer) 1 with the generator 2 connected at the $TE_{10}$ section. The $TE_{20}$ section being closed by a shorting metal wall 3, and a cylindrical load 4 is located approximately at the centreline of the $TE_{20}$ section. A tuning means 5 (here in the form of a rod) extends the whole way between the top and bottom surfaces in the $TE_{20}$ section.

The applicator is air-filled and made up from metal walls according to well-established manufacturing technique for microwave applicators. In the case of a pure $TE_{20}$ mode, the load location at the centreline provides the desired cylindrical $TM_1$ field in the load. The rod 5 (preferably made from a metal) may then not be needed to obtain a symmetrical heating pattern in the load. However, it is of interest to provide a compact design, so in particular the $TE_{20}$ section is quite short. The rod is then very convenient for adjusting the heating pattern; in addition, the rod 5 may also act to stabilise the heating pattern under conditions of different permittivity and dimensional changes of the load, as well as for improving the impedance matching.

The location of the load axis in relation to the shorting wall 3 should in accordance to the first order theory be a quarter mode wavelength away. However, it is normally determined by experiment or by microwave modelling. Since the applicator is primarily intended for loads having a radius exceeding half a wavelength in the load substance, there may be considerable deviations from this first order theory, resulting in the optimum position of the load being closer to the shorting wall. Experiment or microwave modelling is also used for the determination of the diameter and location of the rod 5.

Figure 2:
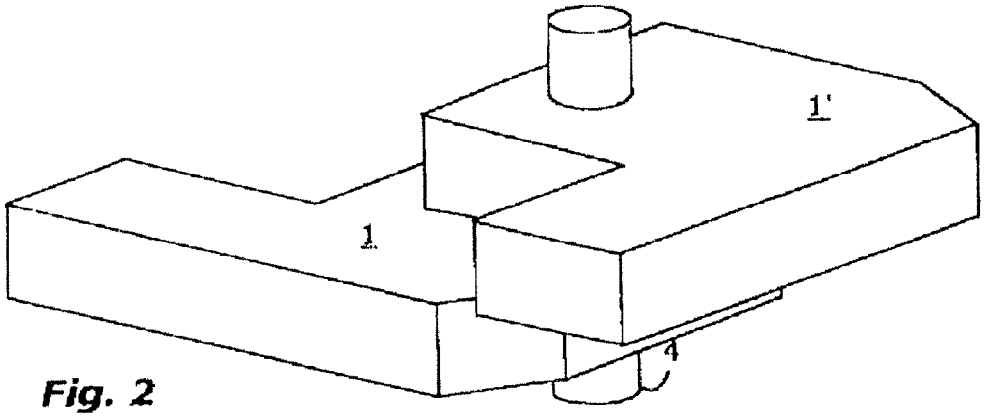
FIG. 2 shows, in perspective, a system consisting of a second applicator placed directly on a first applicator, with a rod-shaped load extending through both applicators.

The second preferred embodiment of the present invention as shown in FIG. 2 relates to a system comprising two applicators 1,1' where the applicators have a common load axis, and that the applicators being rotated by approximately 90° around the load axis in relation to each other. It is naturally possible to arrange additional applicators where each applicator being rotated approximately 90° around the load axis with regard to an adjacent applicator.

Figure 3:
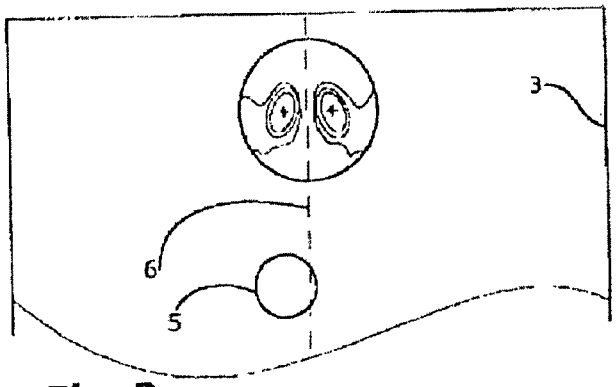
FIG. 3 shows the heating pattern in the central horizontal plane of an applicator according to FIG. 1, as a thermal plot obtained by microwave modelling.

As seen in FIG. 3, the heating pattern has two diametrical maxima (each maximum is indicated by a "+"), one on each side of the $TE_{20}$ waveguide centreline 6; its angular variation can be described by a $\cos^2$ function, according to known mode theory. By the 90° displacement, a second applicator will give a $\sin^2$ variation, so that the summed angular variation will be 1, i.e. not vary at all.

According to a first aspect of the second embodiment of the invention the energy coupling between adjacent 90° displaced applicators by the load field may be made very small, so that the so-called crosstalk between such applicators will be very small, even if the associated generators are simultaneously excited.

Figure 4:
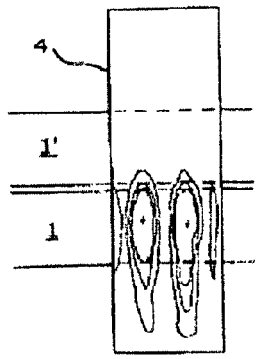
FIG. 4 shows the load heating pattern in a vertical plane containing the load axis and the angular location of the heating maxima of a lower applicator with a very small height, with only the lower applicator energised, in a system consisting of two equal 90° displaced applicators according to FIG. 2, as a thermal plot obtained by microwave modelling.

According to a second aspect of the second embodiment the applicator 1 is designed so that it also works as a choke for the propagating fields from a first applicator through the load to a second applicator. An example of this is shown in FIG. 4, where only the lower applicator 1 is energised, and there is a second applicator 1' just above but none below the first applicator. Actually, this feature is closely related to the first aspect of the second embodiment mentioned above. For efficient choking to be possible, it is necessary that a significant part of the microwave energy is bound to the load 4 is outside it. This may be the case for the $TM_1$ mode type, but is not for the $TM_0$ type mode. In FIG. 4 the heating pattern is schematically illustrated in the same way as in FIG. 3.

For the optimisation of choking, it is firstly to be considered that what needs to be choked in the second, "passive" applicator is a 90° rotated load field from that produced by this second applicator. Hence, the mode type to be choked is $TE_{10}$. The choking action is to be of the source (meaning excited load in this case) firstly being mismatched by the shorting wall 3, secondly by a field mismatch to this $TE_{10}$ mode in the $TE_{20}$ section, and thirdly another field mismatching when the $TE_{10}$ mode in it encounters the transducer section to the $TE_{10}$ section. The third phenomenon has typically the strongest effect, and the procedure for choking optimisation is then by variation of the length of the $TE_{20}$ section, which is arbitrary with regard to the proper function of the applicator in heating mode, since the transition section as such is matched for that primary power flow. The second parameter, for fine-tuning of the two functions of the applicator, is to vary the location of the load axis in relation to the shorting wall 3, in combination with the use of one or several metal rods 5. Rather than performing this co-optimisation of heating and choking functions by hardware experiments, microwave modelling may be employed and will also allow studies of the various field patterns and intensities to assist in the work.

A third embodiment of the present invention relates to the design and use of multiple, low and closely stacked applicators to achieve high power densities in elongated or moving loads. The $TE_{20}$ mode can in theory exist in a waveguide with arbitrarily small height, but there are of course practical limitations by the fact that the waveguide (integrated) impedance is proportional to its height, requiring a very large transformation ratio from the typically standard height of between a quarter and a half free space wavelength at magnetron generator transition to the $TE_{10}$ portion.

Figure 5:
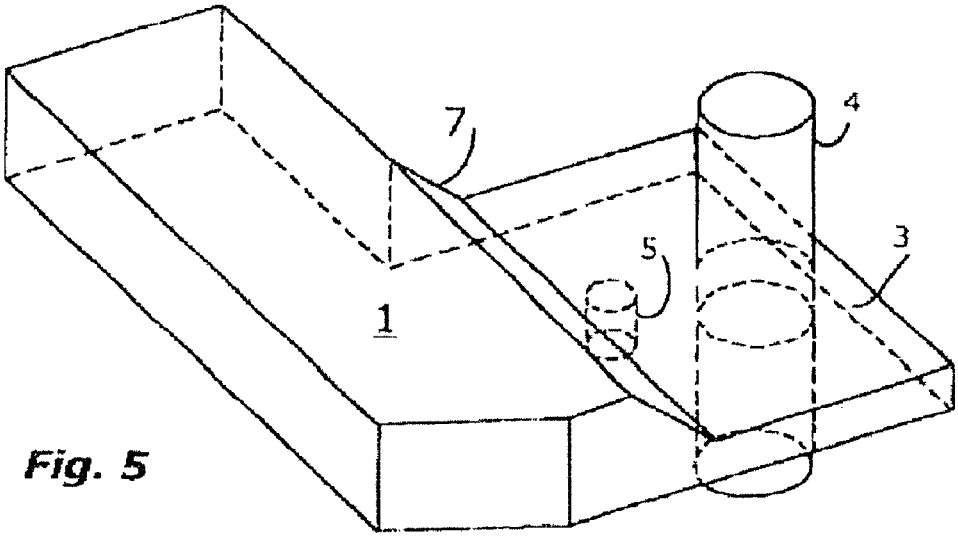
FIG. 5 shows an alternative embodiment of the applicator where the part with the load has been made significantly axially smaller than the generator feed $TE_{10}$ end.

There are, however, generally no problems when the height is changed in one short step 7 as shown in FIG. 5, by a factor of up to 3. This is then normally in the $TE_{20}$ section as shown in the same figure. The step can also be used to improve the choking function, as described for the overall length of the $TE_{20}$ section for the second embodiment of the present invention.

An important aspect of the present invention in conjunction with the use of very low applicator heights is that the load location is where the electrical field of the $TE_{20}$ mode (there is in essence only a vertical such field) is minimum. Hence, the risk of arcing when high power is used is very much less than with rectangular $TE_{10}$ applicators (or, equivalently, cylindrical $TM_{0n0}$ applicators).

By the combined use of multiple 90° displaced applicators with mutual choking function, extremely high heating intensities can quite easily be achieved also with typical magnetron powers, without any risk of arcing.

As an example when using 2450 MHz, a $TE_{20}$ section height of 12 mm with a load diameter of 30 mm and 3 kW microwave generators in a 6-applicator system (plus two non-energised end-choking applicators) will result in 18 kW over a total length of 8×14 mm=112 mm, i.e. 80 mL. With a specific heat capacity of the load of half of that of water, the heating rate then becomes over 100 K/second. Such heating rates may be desirable in pharmaceutical microwave chemistry applications, where polar liquids with reactants are very rapidly heated under high pressure to over 200° C. Of course, larger systems using the other common microwave heating frequency band using a frequency around 915 MHz can achieve the same heating rate with commercially available magnetrons of 30 kW and higher. Such applications may include very rapid expansion causing cell wall rupturing in some types of hardwood, where a slower heating rate would result in energy waste by loss of pressure by diffusion thus requiring prolonged heating time; or malfunction of the process by rupturing not occurring at all.

An example of the choking function also confining the heating pattern to only the energised applicator is shown in FIG. 4 where an upper and a lower applicator are indicated.

The two stacked waveguide applicators (as illustrated in FIG. 2) are 25 mm high (b dimension) and the $TE_{10}$ and $TE_{20}$ sections are 86 and 172 mm wide (a dimension), respectively. The load diameter is 40 mm, its permittivity is 25-j6, the load is contained in a 5 mm material thickness glass tube with permittivity 4 and the operating frequency is 2450 MHz. The distance from the $TE_{20}$ shorting wall to the centrally located load axis is 28 mm; the metal rod has a diameter of 17 mm and is located 10 mm to the left (in the direction of the $TE_{10}$H knee inner corner) and 80 mm from the $TE_{20}$ shorting wall. There is a protective metal tube below and above the load, outside the applicators (indicated as 4 in FIG. 2). Only the lower applicator is energised. With a mode transducer optimised triangular cut in the outer H knee corner of 29 mm at the $TE_{10}$ side and 86 mm at the $TE_{20}$ side (as indicated in for example FIG. 1) and an optimised distance between the $TE_{20}$ shorting wall to the opposite side wall of 210 mm, the transmission factor between the two $TE_{10}$ ports of the applicators becomes 0,03 (which is the same as −30 dB crosstalk power).

Figure 6:
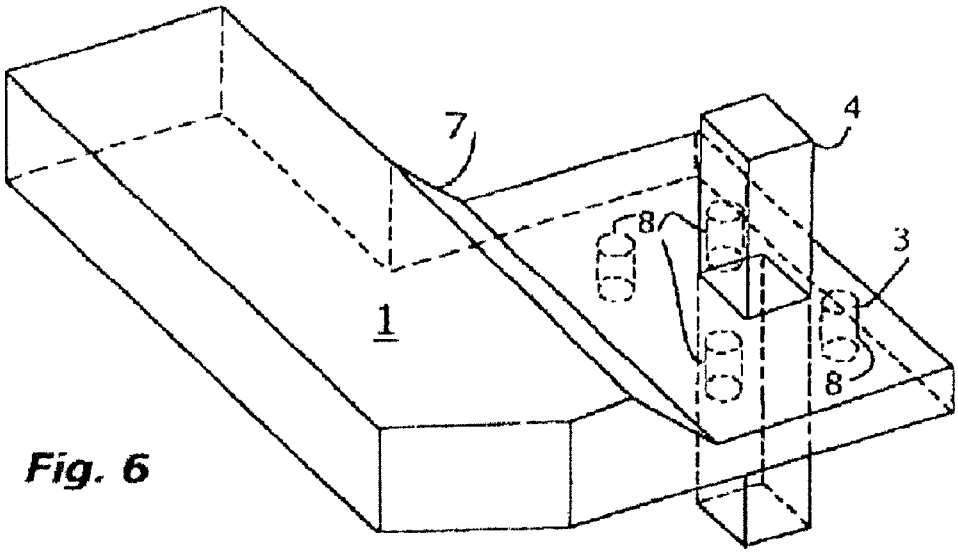
FIG. 6 shows a further alternative embodiment of the applicator in a system where the load is a square cross section load.

In a fourth embodiment of the present invention additional metal rods 8 are used as shown in FIG. 6, with loads of such cross sectional size or shape that some deviations from the $\sin^2$ angular variation occurs. Such variations are primarily caused by internal resonance effects in the load, or by non-resonant edge diffraction if the load has axial edges. The method for determining the locations and sizes of these rods is again primarily by microwave modelling. It is then generally preferred to arrange four rods in a square pattern if the load cross section is also square (as in FIG. 6), to maintain the capability for choking by adjacent applicators. The rod pattern can then be varied by both side length and angular position in relation to the $TE_{20}$ waveguide axis direction.

Figure 7:
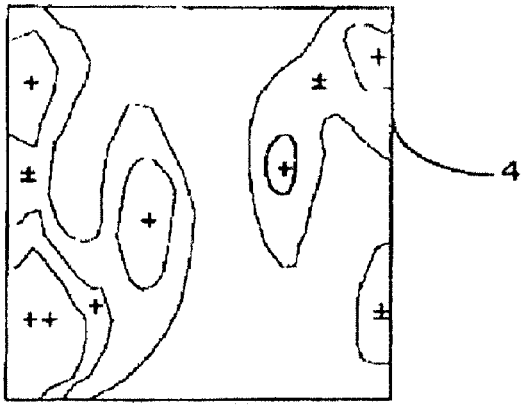
FIG. 7 shows an example of heating pattern in the central cross section plane of an applicator according to the present invention.

An example of heating pattern in the central cross section plane of a 100×100 mm square, long load with permittivity 30-j3 at 915 MHz in an applicator with 60 mm height and 500 mm $TE_{20}$ section width is shown in FIG. 7. The heating pattern is illustrated by using "++" for the warmest part, "+" for the next warmest parts and so on to the coldest part that is indicated with a "−". In this case there are no rods or other devices, and the load axis is 126 mm from the shorting wall and displaced by 18 mm from the applicator centreline. It is seen that the heating pattern becomes quite even with two, and even more so with four 90° displaced applicators.

Figure 8:
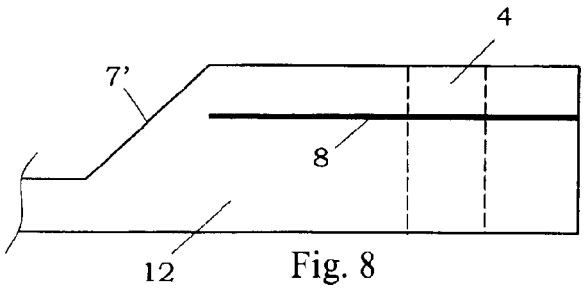
FIG. 8 shows a cross-sectional view of an alternative embodiment of the applicator where the part with the load has been made significantly axially larger than the generator feed $TE_{10}$ end.
Figure 9:
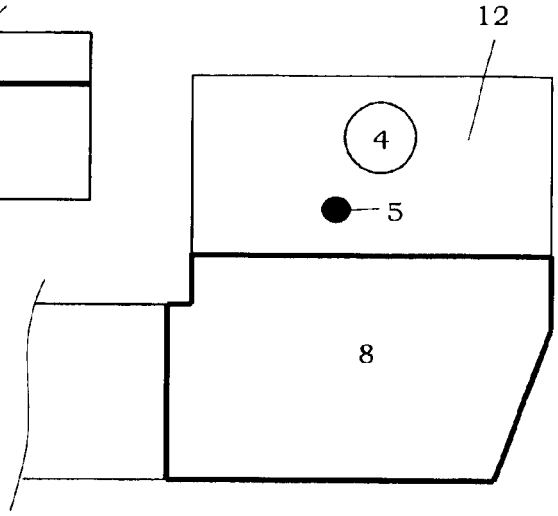
FIG. 9 shows a view from above schematically illustrating the embodiment shown in FIG. 8

According to a fifth embodiment of the present invention the applicator is substantially thicker at least in the part of the $TE_{20}$ mode section where the load is arranged than in the $TE_{10}$ mode section, in a direction perpendicular to the major wave propagation. This fifth embodiment is illustrated in FIGS. 8 and 9. Thus, the present invention also includes applicators with larger heights, up to more than a full free space wavelength.

Even if it may be possible to successfully just increase the applicator height (7' in FIG. 8) by making either a step or a slope 7 as shown in FIG. 5 (but now to a larger instead of a smaller height) to fit a load higher than about a half free space wavelength, and then obtain a reasonably even heating in the axial direction, typical variations in load permittivity and load filling height will almost inevitably result in heating concentrations at either load end.

A refinement of this embodiment of the invention is to then use metal plates parallell to the broad sides (floor and ceiling) of the applicator. One metal plate 8 is seen in FIGS. 8 and 9. These plates may be in continuous galvanic contact with the side (vertical) applicator walls, but that is not necessary for proper function. A plate acts as a mode filter, prohibiting propagation of other than $TE_{20p}$ modes, provided the (vertical) distance between any plate(s) and the applicator floor or ceiling does not exceed about a half free space wavelength. Several plates may thus be used.

An extension of this embodiment is to firstly employ an upwards slope 7' from a part of the applicator near or in its feed by a $TE_{10}$ waveguide, or near the dielectric rod feed, being the transducer means according to the sixth embodiment described below, and secondly use a metal plate which extends to a position rather close to the slope. This is illustrated in FIG. 8 where the metal plate 8 extends close to the waveguide slope 7' and the opposite applicator side wall in one cross section, and from the side wall of the $TE_{10}$ waveguide almost all the way to the load in the perpendicular cross section.

FIG. 9 schematically illustrates the fifth embodiment from above where is shown the $TE_{20}$ mode section 12 provided with a metal plate 8, a load 4 and a tuning means 5.

It is also possible to use plates, which are bent up-, or downwards in the feed region, to achieve the same goal which is to split the incoming power in a controlled way, to achieve an improved heating evenness in the axial direction of the load.

By using one or two metal plates as just described, it is possible to use applicator and load heights up to and exceeding a free space wavelength of the microwaves, while maintaining a reasonably even heating in the axial direction, for limited intervals of liquid column height but for wide variations of the dielectric properties of is as a load.

According to a sixth embodiment of the present invention a generalised transducer means is arranged between the waveguide transition between the $TE_{10}$ mode section and $TE_{20}$ mode section. This generalised transducer means will be described with references to FIGS. 10 and 11. The transducer means is applicable to all embodiments of the present invention described herein.

Figure 10:
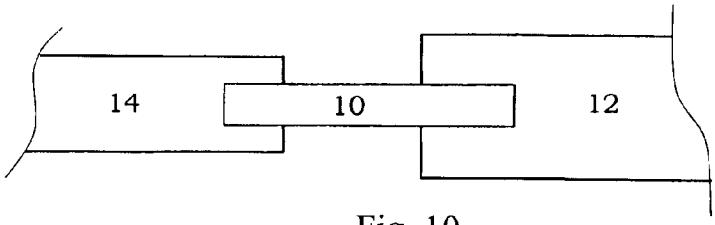
FIG. 10 shows a cross-sectional view of a sixth embodiment of the present invention.
Figure 11:
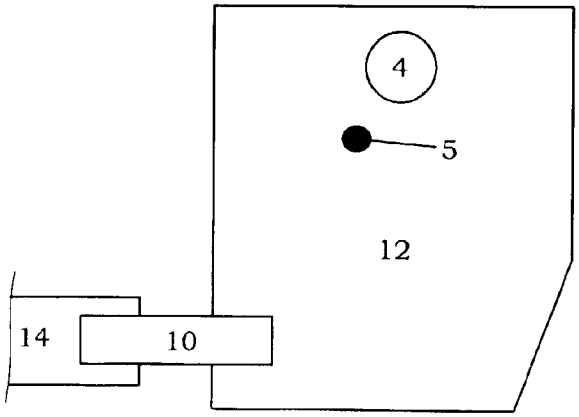
FIG. 11 shows a view from above schematically illustrating the embodiment shown in FIG. 10.

FIG. 10 shows a cross-sectional view of the sixth embodiment of the present invention and FIG. 11 shows a view from above schematically illustrating the same embodiment.

FIG. 10 a schematic illustration showing the $TE_{10}$ mode section 14, a transducer means 10 and the $TE_{20}$ mode section 12. The same features are shown in FIG. 11 that in addition show the load 4 and the tuning means 5. The transducer means 10 includes a dielectric-filled waveguide carrying the same mode as the rectangular $TE_{10}$, which is equivalent to the circular $TE_{11}$ mode.

There is often a need for separating the generator and applicator parts of the system, so that for example noxious gases or load spillage cannot escape out from the applicator towards the generator and other ancillary equipment. There may also be a need to heat the liquid load to temperatures above its boiling temperature under atmospheric pressure. Such pressurised windows are just variable thickness, microwave transparent plates under mechanical pressure between two $TE_{10}$ waveguide flanges. The impedance mismatching due to the plate is commonly so small (since the plate is relatively thin) that compensation is made by simple discrete components such as metal posts in the waveguide. For thicker windows, the fact that a half wavelength thick plate (of the window material) may minimise reflections may be employed. Conical tapering into both the mating waveguides using low permittivity plastic material bodies is another possibility. According to this sixth embodiment of the present invention a mode transition between the $TE_{10}$ airfilled waveguide and a circular $TE_{11}$ or rectangular $TE_{10}$ mode in the form of the transducer means 10 being a dielectric filled metal tube or bore. Such a transducer means is fed from a symmetrically located hole in the shorted end of the $TE_{10}$ waveguide and is impedance matched without any additional means. The length of the dielectric-filled waveguide portion can therefore be arbitrarily long. This design is inherently different to prior art windows by the intermediate dielectric-filled waveguide section being impedance matched to the airfilled waveguide.

A preferred design of the transducer means is shown in FIG. 10, where a rectangular $TE_{10}$ waveguide 14 has a lower height (commonly labelled b dimension) than the other similar waveguide 12. A circularly cylindrical ceramic body 10 protrudes certain but different distances into the waveguide ends, and is surrounded by metal between the waveguides. There are no additional matching components.

This type of matched transducer means requires certain dielectric data and diameters of the body, in relation to the rectangular waveguide dimensions and operating frequencies, in order for a sufficiently broadband impedance matching to be achieved. As a first example, with the standard WG340 (43×86 mm) waveguide in the 2450 MHz ISM band, an alumina rod with permittivity 9 must be about 29 mm in diameter and protrude about 25,5 mm into the waveguide. As a second example, with a 60×86 mm waveguide and a rod with permittivity 6,8, its diameter must be about 38 mm and the protrusion must be about 28 mm. Establishing optimum dimensions for waveguides and rods with other data can be made by experiment or numerical microwave modelling, using the start data above. This also applies when the rod has a square or rectangular cross section. If one of the waveguides is subjected to pressure, for example by the applicator being a direct continuation of the waveguide 12, the protruding part of the rod 10 can be made slightly wider than the rest, so that the rod cannot slide away. The protrusion length of the wider part must than be made somewhat shorter. Other deviations from the cylindrical shape can also be employed for the purpose, and are all within the scope of the invention as defined by the appended claims. When using a rod feed of the type just described, it is not necessary to feed the applicator via a $TE_{10}$ waveguide. Instead, the rod may be protruding directly into the $TE_{20p}$ applicator. This is shown in FIG. 11 where the applicator 12 with a load 4 and a tuning means 5 is disclosed.

According to an additional improvement of the present invention in particular with regard to the insensitivity to liquid column height variations is to employ rod-shaped dielectric bodies with rather high permittivity, parallell to the metal rod 5. The rods must then have a permittivity comparable with that of the liquid load, and also a comparable cross section area. As an example, two rods with permittivity 20 and diameter 30 mm are located close to the load, on each side of the $TE_{20}$ centreline. The sensitivity to liquid column height variations, as well as to load permittivity variations, is then reduced. Also the impedance matching variations for variations of these load parameters is reduced.

A typical applicator for 2450 MHz will have horizontal dimensions about 170×210 mm, plus the prolongation by a $TE_{10}$ feed waveguide. With a diameter of the load container of about 55 mm, the filling factor (load volume divided by applicator volume) becomes quite small. There may be instances when it is desirable to reduce the applicator dimensions. This can then be made by three methods:

1. Folding down or up the outer parts of the $TE_{20}$ part (i.e parallel to the power flow direction) so that an inverted U shape is created. The applicator feed is then from below or above. However, this method is not efficient if the waveguide applicator height is large.
2. Inserting metal ridges in the $TE_{20}$ part, in the same way as in standard ridged waveguides. This means that two ridges, ending on each side of the load, are introduced.
3. Inserting partial dielectric filling in the $TE_{20}$ part. As an example, using PTFE with about 50% filling factor, the 170×210 mm dimensions can be reduced to about 125×155 mm.

As a further alternative, in particular with regard to the above-mentioned second method related to the ridged waveguide, the waveguide (the $TE_{20}$ mode section) is filled (or partly filled) with a dielectric material, e.g. PTFE or a ceramic material. This is mainly in order to decrease the size of the $TE_{20}$ mode section.

The present invention also relates to the use of the applicator, the system or the method for performing organic chemical synthesis reactions, and also for very rapid heating of wood, for cell wall disruption or similar.

Within the scope of the invention as it is defined by the appended claims also the following exemplary structural alternatives are included:

The metal rods must not go the whole way between the major planes of the waveguides Instead of using rods, metal plates may be used.

The metal plates may be replaced by dielectric inserts or tubing, for example alumina ceramic.

In order to achieve an improved heating at the load axis, the load may be displaced somewhat from the position which gives a symmetrical heating pattern.

The load may be in a microwave transparent tube or holder.

The load may be short and entirely located inside a single applicator.

The $TE_{10}$ section may be bent and extended so that there is sufficient space for the generators also when multiple, low stacked applicators are used Systems may be designed for any microwave frequency, depending on the load dimensions, dielectric properties and required capacity of the system. For reasons of availability of generators, and since the systems are primarily foreseen for high power density applications, the standard frequencies about 2450 and 915 MHz are preferred.

What is claimed is:

1. A microwave applicator for heating loads being a waveguide transition between the rectangular $TE_{10}$ and $TE_{20}$ modes comprising a $TE_{10}$ mode section and a $TE_{20}$ mode section, wherein said load being inside said $TE_{20}$ mode section and is located with its major axis perpendicularly to the major propagation direction of the $TE_{20}$ mode, close to a shorting wall of said $TE_{20}$ mode section and also close to the centreline of said propagation direction, wherein at least one tuning means is arranged extending through the applicator and being located close to the load so as to provide an essentially symmetrical cylindrical $TM_1$ type mode pattern in the load.

2. Microwave applicator according to claim 1, wherein microwave energy is applied to the applicator via a feeding means arranged at the $TE_{10}$ mode section.

3. Microwave applicator according to claim 1, wherein a dielectric transducer means is arranged between the $TE_{10}$ mode section and $TE_{20}$ mode section.

4. Microwave applicator according to claim 3, wherein said dielectric transducer means includes a tube filled with a dielectric material.

5. A microwave applicator for heating loads being a waveguide transition between the rectangular $TE_{10}$ and $TE_{20}$ modes comprising a $TE_{10}$ mode section and a $TE_{20}$ mode section, wherein said load being inside said $TE_{20}$ mode section and is located with its major axis perpendicularly to the major propagation direction of the $TE_{20}$ mode, close to a shorting wall of said $TE_{20}$ mode section and also close to the centreline of said propagation direction, wherein said applicator is substantially thinner at least in the part of the $TE_{20}$ mode section where the load is arranged than in the $TE_{10}$ mode section, in a direction perpendicular to the major wave propagation.

6. A microwave applicator for heating loads being a waveguide transition between the rectangular $TE_{10}$ and $TE_{20}$ modes comprising a $TE_{10}$ mode section and a $TE_{20}$ mode section, wherein said load being inside said $TE_{20}$ mode section and is located with its major axis perpendicularly to the major propagation direction of the $TE_{20}$ mode, close to a shorting wall of said $TE_{20}$ mode section and also close to the centreline of said propagation direction, wherein said applicator is substantially thicker at least in the part of the $TE_{20}$ mode section where the load is arranged than in the $TE_{10}$ mode section, in a direction perpendicular to the major wave propagation.

7. Microwave applicator according to claim 6, wherein at least one metal plate is arranged in said $TE_{20}$ mode section in order to act as a mode filter.

8. Microwave applicator according to claim 1, wherein said tuning means is made from metal.

9. Microwave applicator according to claim 1, wherein said tuning means is made from a dielectric material, e.g. alumina.

10. Microwave applicator according to claim 1, wherein said two or four tuning means are arranged diametrically pairwise surrounding the load.

11. Microwave applicator according to claim 1, wherein said tuning means is rod-shaped.

12. Microwave applicator according to claim 1, wherein said load has a cross section that is essentially circular.

13. Microwave applicator according to claim 1, wherein said $TE_{20}$ mode section is at least partly filled with a dielectric material, e.g. PTFE or a ceramic material.

14. A system consisting of at least two microwave applicators according to claim 1, wherein said applicators have a common load axis, and that adjacent applicators being rotated by approximately 90° around said load axis.

15. System according to claim 14, wherein at least one of the applicators being energized, and that adjacent energized or non-energized applicators act as chokes for adjacent energized applicators.

16. A method for designing an applicator according to claim 1, wherein the method comprises:

using an essentially complete mode transducing function between rectangular $TE_{10}$ and $TE_{20}$ of the 90° H knee type, shorting the $TE_{20}$ end and locating the load with its major axis perpendicularly to the major propagation direction of the $TE_{20}$ mode, close to a shorting wall of said section and close to the centreline of said propagation direction, introducing a tuning means between opposite major walls of the waveguide near the load, establishing a $TM_1$ type field in the load by performing experiments or microwave modelling using the diameter and positions of the tuning means as variables.

17. A method according to claim 16, wherein said method further comprises:

changing the length of the $TE_{20}$ section by experiment or microwave modelling, until the crosstalk between the applicators becomes minimal.

18. A method according to claim 16, wherein the method further comprises:

changing the thickness of the $TE_{20}$ section by experiment or microwave modelling.

19. A method according to claim 16, wherein the method further comprises:

adding a second, 90° displaced but otherwise identical applicator, so that the load axis becomes common.

20. A method according to claim 16, wherein the method further comprises:

adapting the applicator for a load having a non-circular cross section by using two or four tuning means that at least diametrically pair wise surrounding the load, and by varying the positions of these tuning means by experiment or microwave modelling until an acceptably even integrated heating has been achieved.

21. Use of an applicator, a system or a method according to claim 1, for performing organic chemical synthesis reactions.

22. Use of an applicator, a system or a method according to claim 1, for very rapid beating of wood, for cell wall disruption or similar.

23. A method for designing an applicator according to claim 14, wherein said method comprises:

using an essentially complete mode transducing function between rectangular $TE_{10}$ and $TE_{20}$ of the 90° H knee type, shorting the $TE_{20}$ end and locating the load with its major axis perpendicularly to the major propagation direction of the $TE_{20}$ mode, close to a shorting wall of said section and close to the centreline of said propagation direction, introducing said tuning means between opposite major walls of the waveguide near the load, establishing a $TM_1$ type field in the load by performing experiments or microwave modelling using the diameter and positions of the tuning means as variables.

24. A method for designing an applicator according to the system of claim 15, wherein said method comprises:

using an essentially complete mode transducing function between rectangular $TE_{10}$ and $TE_{20}$ of the 90° H knee type, shorting the $TE_{20}$ end and locating the load with its major axis perpendicularly to the major propagation direction of the $TE_{20}$ mode, close to a shorting wall of said section and close to the centreline of said propagation direction, introducing said tuning means between opposite major walls of the waveguide near the load, establishing a $TM_1$ type field in the load by performing experiments or microwave modelling using the diameter and positions of the tuning means as variables.

25. A method according to claim 23, wherein said method further comprises:

changing the length of the $TE_{20}$ section by experiment or microwave modelling, until the crosstalk between the applicators becomes minimal.

26. A method according to claim 24, wherein said method further comprises:

changing the length of the $TE_{20}$ section by experiment or microwave modelling, until the crosstalk between the applicators becomes minimal.

* * * * *